US010174945B2

(12) United States Patent
Schalles et al.

(10) Patent No.: US 10,174,945 B2
(45) Date of Patent: Jan. 8, 2019

(54) BURNER PORT BLOCK ASSEMBLY

(71) Applicant: Bloom Engineering Company, Inc., Pittsburgh, PA (US)

(72) Inventors: David G. Schalles, Jefferson Hills, PA (US); James N. Checkeye, Butler, PA (US)

(73) Assignee: BLOOM ENGINEERING COMPANY, INC., Pittsburgh, PA (US)

( * ) Notice: Subject to any disclaimer, the term of this patent is extended or adjusted under 35 U.S.C. 154(b) by 498 days.

(21) Appl. No.: 15/029,025

(22) PCT Filed: Sep. 18, 2014

(86) PCT No.: PCT/US2014/056289
§ 371 (c)(1),
(2) Date: Apr. 13, 2016

(87) PCT Pub. No.: WO2015/057345
PCT Pub. Date: Apr. 23, 2015

(65) Prior Publication Data

US 2016/0258621 A1 Sep. 8, 2016

Related U.S. Application Data

(60) Provisional application No. 61/890,504, filed on Oct. 14, 2013.

(51) Int. Cl.
*F23M 5/02* (2006.01)
*F27D 99/00* (2010.01)

(52) U.S. Cl.
CPC ..... *F23M 5/025* (2013.01); *F27D 99/0033* (2013.01); *F23M 2900/05004* (2013.01); *F23M 2900/05021* (2013.01)

(58) Field of Classification Search
CPC ..... F23M 5/025; F23M 2900/05021; F23M 2900/05004
See application file for complete search history.

(56) References Cited

U.S. PATENT DOCUMENTS 3,101,773 A 8/1963 Blaha
4,168,950 A * 9/1979 Seemann ..... F23M 5/025 431/348

(Continued)

FOREIGN PATENT DOCUMENTS

EP 0398252 A2 11/1990
JP 2001141203 A 5/2001

(Continued)

OTHER PUBLICATIONS

Elster LBE, SicaFlex® segmented flame tube brochure, 2008.
Fives North American, Burner Tile Installation Recommendations for Fiber-Lined Furnaces, Jun. 2007.

*Primary Examiner* — David J Laux
(74) *Attorney, Agent, or Firm* — The Webb Law Firm

(57) ABSTRACT

A burner port block assembly having a refractory block with a central passageway therethrough and a ceramic extension piece disposed at least partially in the central passageway of the refractory block. The extension piece has a distal end, a proximal end, and a sidewall that defines a central passageway extending between the distal end and the proximal end. The central passageway of the refractory block is provided with a first engagement structure and the sidewall of the extension piece is provided with a second engagement structure. Engagement of the first engagement structure with the second engagement structure connects the extension piece to the refractory block. The burner port block assembly may further include at least one ceramic fiber board having a hole therethrough disposed at the distal end of the (Continued)

refractory block and/or a gasket positioned between the refractory block and the extension piece.

21 Claims, 6 Drawing Sheets

(56) References Cited

U.S. PATENT DOCUMENTS

| | | | | | |
|---|---|---|---|---|---|
| 4,741,279 | A | * | 5/1988 | Azuhata | F23C 7/004 110/264 |
| 4,759,297 | A | | 7/1988 | McNally et al. | |
| 5,346,390 | A | | 9/1994 | Slavejkov et al. | |
| 5,348,468 | A | * | 9/1994 | Graf | F23D 14/16 431/171 |
| 5,449,287 | A | | 9/1995 | Simko | |
| 5,551,867 | A | * | 9/1996 | Shamp | F23M 5/025 431/154 |

FOREIGN PATENT DOCUMENTS

| | | | |
|---|---|---|---|
| JP | 2007315669 | A | 12/2007 |
| KR | 19970009482 | B1 | 6/1997 |

* cited by examiner

BURNER PORT BLOCK ASSEMBLY

CROSS REFERENCE TO RELATED APPLICATIONS

The present application claims priority from U.S. Provisional Patent application No. 61/890,504, filed on Oct. 14, 2013, which is incorporated herein by reference in its entirety.

BACKGROUND OF THE INVENTION

Field of the Invention

The present invention relates to a burner port block assembly for conveying the heat and hot gases from a burner to a furnace. More specifically, the invention is directed to a burner port block assembly having a ceramic insert and a reduced size refractory block.

Description of Related Art

Direct fired burners, where the flame, heat, and products of combustion are fired directly into the furnace atmosphere, have been used since the 1960's, especially in the direct-fired section of strip galvanizing line preheaters. Between the burner and the furnace wall is a port block, also known as a tile or a quarl, through which the flame, heat, and hot gases pass into the furnace. In many applications, including "non-oxidizing" or "NOF" furnaces, the port block runs unusually hot and can reach surface temperatures in excess of 2800° F.

Historically, the walls of this type of furnace were lined with firebrick. Thus, the furnace wall heat storage capacity was quite high, causing the furnaces to heat up and cool down slowly. Port blocks made of 3000° F. or better material would normally retain their structural integrity in service for at least as long as the lining of the furnace walls.

Some users of this type of furnace have begun lining the furnace walls with fiber linings instead of furnace brick. This allows the furnace to be heated and cooled much more quickly, giving more operating flexibility. However, the castable monolithic refractory port blocks become a weak point in this type of operation. In general, the thick monolithic refractory port blocks are not well suited for rapid thermal cycling, especially rapid cool-down, and tend to crack and fall apart under these conditions.

While this problem has been known for at least 10 years, no suitable solution has been found. Many studies have been commissioned to study the thermal shock failure of the monolithic refractory port blocks without a successful solution being identified. Thus, a port block is needed that will withstand the rapid heating and cooling experienced in these fiber lined furnaces without significant degradation.

SUMMARY OF THE INVENTION

The present invention is directed to a burner port block assembly comprising a refractory block having a central passageway therethrough and a ceramic extension piece disposed at least partially in the central passageway of the refractory block. The extension piece comprises a distal end, a proximal end, and a sidewall that defines a central passageway extending between the distal end and the proximal end. The refractory block is provided with a first engagement structure and the extension piece is provided with a second engagement structure. Engagement of the first engagement structure with the second engagement structure connects the extension piece to the refractory block. The first engagement structure may be in the central passageway of the refractory block and the second engagement structure may be on the sidewall of the extension piece.

The refractory block may further comprise at least one lip extending inward from the distal end of the central passageway.

The extension piece may comprise at least one outwardly extending bulge in the sidewall at the proximal end, an indentation in the sidewall adjacent the at least one bulge, and/or a longitudinal section of the sidewall adjacent the indentation. The extension piece may also comprise an outwardly extending flange at the distal end. When the extension piece has an indentation in the sidewall, the outer diameter of the extension piece at the indentation is less than the diameter of the central passageway of the refractory block at the at least one lip. The outer diameter of the longitudinal section is greater than the diameter of the central passageway of the refractory block at the at least one lip. The extension piece may be comprised of silicon carbide.

The first engagement structure may comprise at least one recess in the central passageway of the refractory block defined by the at least one lip, and the second engagement structure may comprise at least one outwardly extending bulge at the proximal end of the sidewall of the extension piece. The refractory block is connected to the extension piece when the bulge is disposed within the recess. The outer diameter of the extension piece at the at least one bulge may be smaller than the diameter of the central passageway of the refractory block at the recess and larger than the diameter of the central passageway of the refractory block at the at least one lip. If the extension piece further comprises an indentation in the sidewall, the outer diameter of the extension piece at the indentation is less than the diameter of the central passageway of the refractory block at the at least one lip, such that the lip is at least partially disposed in the indentation when the bulge is disposed in the recess.

The first engagement structure may comprise two recesses in the central passageway of the refractory block defined by two lips and the second engagement structure may comprise two outwardly extending bulges at a proximal end of the sidewall of the extension piece. The recesses may be opposite one another on the circumference of the central passageway of the refractory block and the bulges may also be opposite one another on the circumference of the extension piece.

The burner port block assembly may further comprise a gasket positioned between the refractory block and the extension piece. The gasket may be ceramic fiber and may cover the outer circumference of the proximal end of the extension piece.

The burner port block assembly may further comprise at least one ceramic fiber board having a hole therethrough. The fiber board is located at the distal end of the refractory block and the longitudinal axis of the hole is aligned with the longitudinal axis of the refractory block. The outer diameter of the longitudinal section of the sidewall of the extension piece may be less than a diameter of the hole and the outwardly extending flange of the extension piece may abut an outer surface of the at least one ceramic fiber board.

The present invention is also directed to a method of constructing a burner port block assembly. A refractory block, as described above, is provided and at least one ceramic fiber board, as described above, is attached to the distal end of the refractory block such that the longitudinal axis of the hole in the fiber board is aligned with the longitudinal axis of the refractory block. A gasket is placed around the proximal end of the above-described extension piece and the extension piece is inserted into the central passageway of the refractory block. The extension piece is then rotated with respect to the refractory block to engage the first engagement structure with the second engagement structure.

DESCRIPTION OF THE INVENTION

Figure 1:
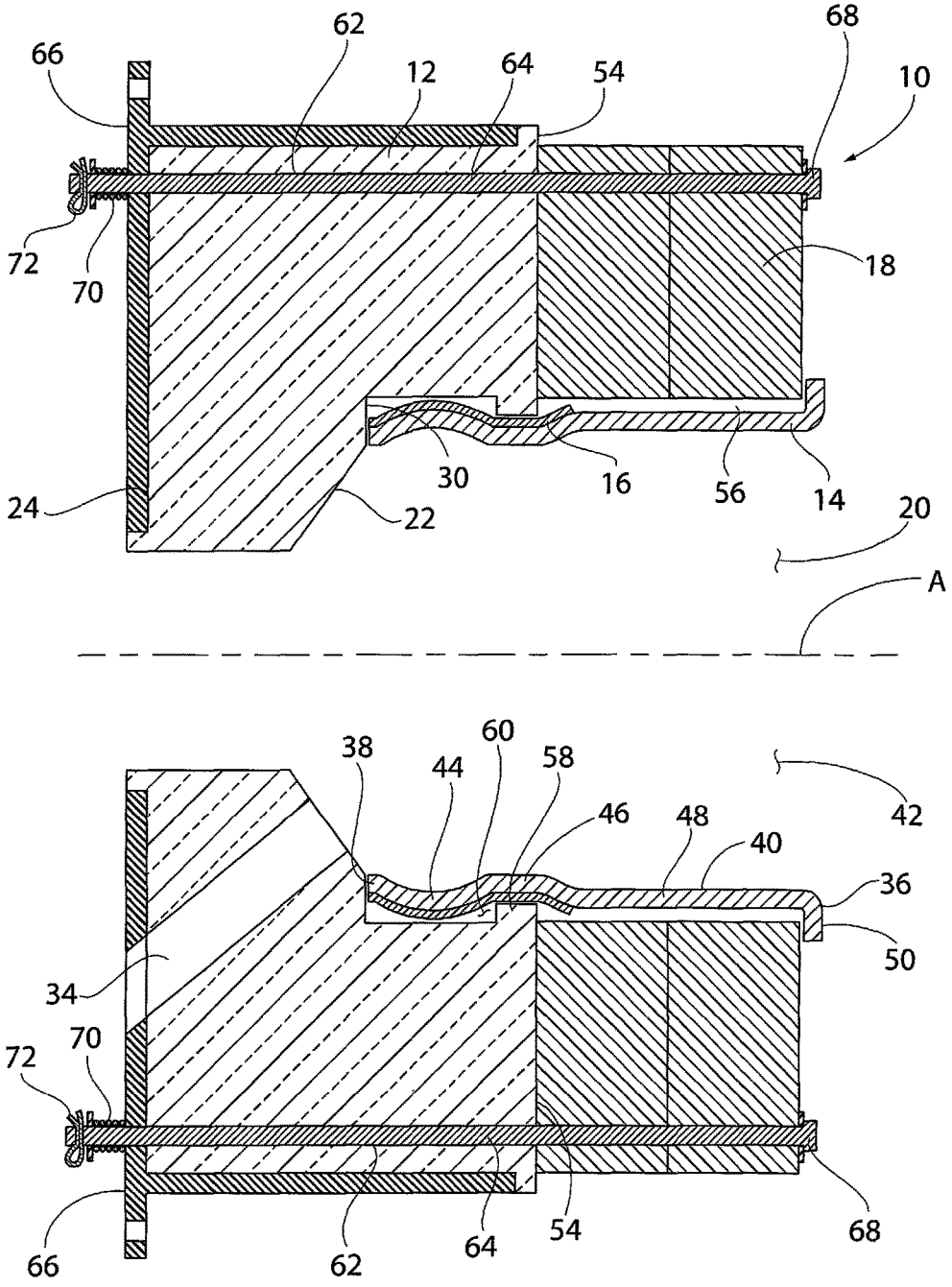
FIG. 1 is a cross-sectional view along a longitudinal axis of a port block assembly according to a first embodiment of the present invention.

For purposes of the description hereinafter, terms such as "end", "outer", "inner", "right", "left", "vertical", "horizontal", "top", "bottom", "longitudinal", and other such descriptive terms shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. Further, it is to be understood that the invention may assume various alternative variations and step sequences, except where expressly specified to the contrary.

A first embodiment of the port block assembly 10, shown in FIG. 1, comprises a refractory block 12, a ceramic extension piece 14, a gasket 16, and at least one ceramic fiber board 18.

Figure 2:
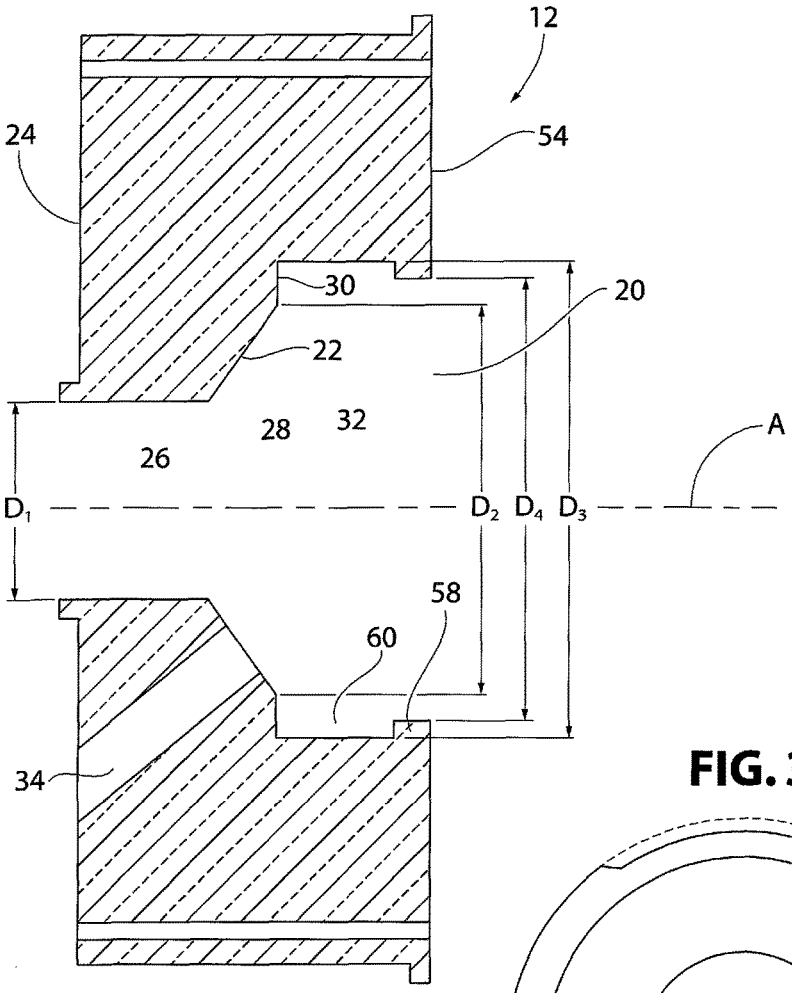
FIG. 2 is a cross-sectional view along a longitudinal axis of a refractory block of a port block assembly according to a first embodiment of the present invention.
Figure 3:
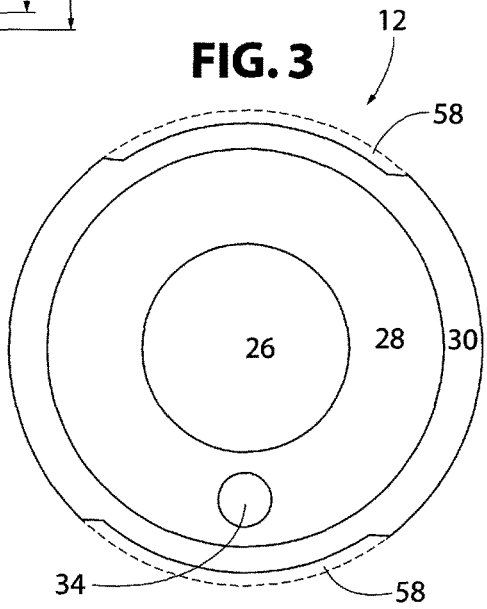
FIG. 3 is a proximal end view of a refractory block of a port block assembly according to a first embodiment of the present invention.

The refractory block 12 is shown in FIGS. 2 and 3. The refractory block 12 has a central passageway 20 defined by a sidewall 22. The proximal end 24 of the refractory block 12 attaches to the burner and a first substantially cylindrical section 26 of the central passageway 20 extends therefrom. The sidewall 22 of the central passageway 20 may then diverge forming a frustoconical section 28. The frustoconical section 28 has a diameter at its proximal end that is equal to the diameter $D_1$ of the first cylindrical section 26 and smaller than the diameter $D_2$ at its distal end. The diameter of the central passageway 20 then enlarges in a stepwise fashion creating ledge 30 and a second substantially cylindrical section 32 having a diameter $D_3$ larger than the diameter $D_1$ of the first cylindrical section 26 and the diameter $D_2$ of the distal end of the frustoconical section 28.

The refractory block 12 may further include one or more ports therethrough extending into the central passageway 20. For example, as shown in FIG. 2, a port 34 is provided for the pilot. The refractory is preferably a castable refractory.

The refractory block 12 may be made of any suitable refractory based on the operating temperature of the furnace, the type of furnace, the type of burner, and other such considerations.

Figure 4:
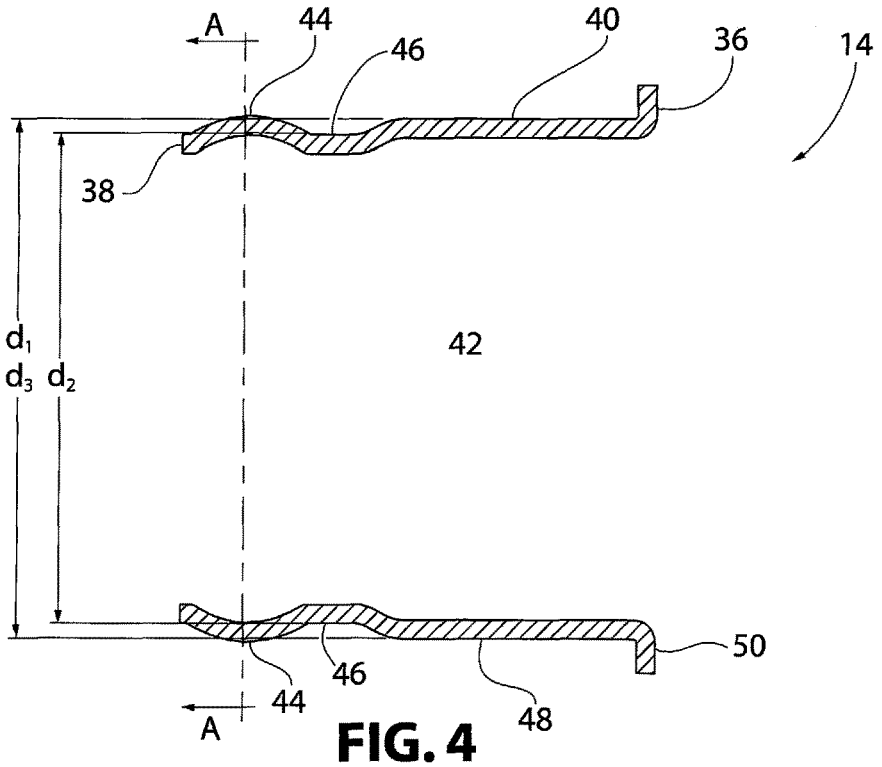
FIG. 4 is a cross-sectional view along a longitudinal axis of an extension piece of a port block assembly according to a first embodiment of the present invention.
Figure 5:
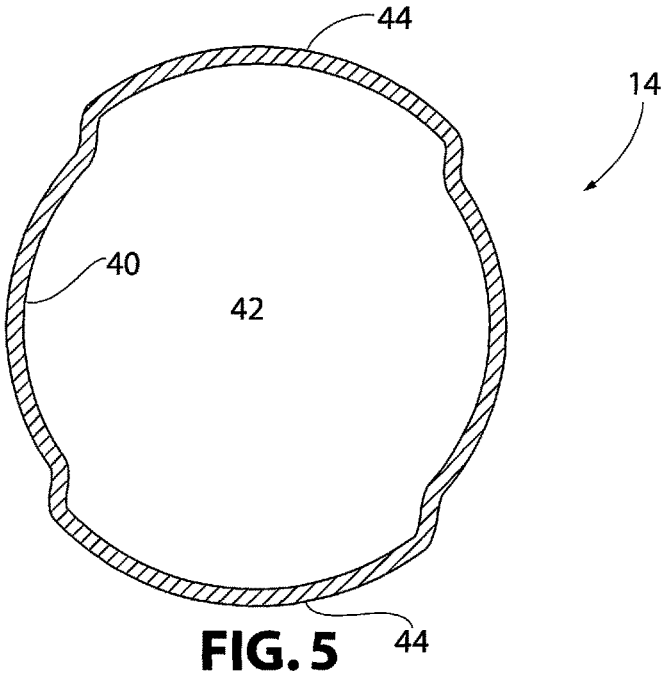
FIG. 5 is a cross-sectional view along A-A in FIG. 4 of an extension piece of a port block assembly according to a first embodiment of the present invention.

The extension piece 14 is shown in FIGS. 4 and 5. The extension piece 14 has a distal end 36, a proximal end 38, and a sidewall 40 that defines a central passageway 42 extending between the distal end 36 and the proximal end 38. At least one bulge 44 is located in the sidewall 40 of the extension piece 14 at its proximal end 38. The bulge 44 extends only a portion of the distance around the circumference of the extension piece 14. In the embodiment shown in FIGS. 4 and 5, there are two bulges 44 each extending approximately one quarter of the way around the circumference of the extension piece 14.

The sidewall 40 of the extension piece 14 may also include an indentation 46 adjacent to the bulge 44. The indentation 46 may only extend a portion of the distance around the extension piece 14 or may extend around the entire circumference of the extension piece 14. The distance that the indentation 46 extends around the circumference of the extension piece 14 may be the same as the distance that the bulge 44 extends around the circumference of the extension piece 14 such that the circumferential length of the indentation 46 corresponds to the circumferential length of the bulge 44.

The sidewall 40 of the extension piece 14 extends from the portion containing the indentation 46 in a generally longitudinal direction such that the central passageway 42 of the extension piece 14 in longitudinal section 48 has a substantially cylindrical shape.

The outer diameter $d_2$ of the extension piece 14 at the indentation 46 is less than the outer diameter $d_1$ of the extension piece 14 at the bulge 44 and the diameter $d_3$ of the longitudinal section 48. The outer diameter $d_1$ of the extension piece 14 at the bulge 44 may be equal to the outer diameter $d_3$ of the longitudinal section 48.

At the distal end 36 of the extension piece 14, a flange 50 extends outwardly from the longitudinal section 48.

The extension piece 14 may be made from any suitable ceramic that provides good resistance to thermal shock including, but not limited to, pre-fired nitrided silicon carbide.

At least one fiber board 18 is provided on a distal end 54 of the refractory block 12. In the embodiment shown in FIG. 1, two fiber boards 18 are provided. The fiber boards 18 may take any shape, but are preferably square, and are provided with a hole 56. The central axis of the hole 56 is aligned with the central axis A of the central passageway 20 of the refractory block 12, and the fiber board 18 is attached to the refractory block 12 using adhesive and/or mechanical anchors including, but not limited to, anchors, screws, bolts, and clips. Alternatively, or in addition, the fiber board 18 may be secured to the furnace walls.

As shown in the embodiment in FIGS. 1 and 2, a mounting plate 66 for attaching the port block assembly 10 to the furnace extends along the proximal surface and sides of the refractory block 12. Anchors 62 may be used to attach the fiber boards 18 to the refractory block 12. The anchors 62 include rods 64 that pass through the fiber boards 18, the refractory block 12, and the mounting plate 66. The anchors 62 are secured on the end adjacent the fiber boards 18 using a ferrule 68 and on the end adjacent the mounting plate 66 using a spring 70 and cotter pin 72 arrangement which allows tension to be maintained in the anchors 62 in the event that the fiber boards 18 shrink.

The number and thickness of the fiber boards 18 is determined by the furnace and burner conditions. Sufficient fiber boards 18 should be provided to insulate the refractory block 12, thus reducing the heating and/or cooling rates of the refractory block 12 with respect to the furnace. As will be understood by a person skilled in the art, a material having properties similar to the material used to line the furnace walls would be preferably used for the fiber board 18. In this way, the exterior of the port block assembly 10 should have the same structural integrity as the furnace walls upon heating and cooling, and the refractory block 12 will be protected from extreme heating and cooling rates improving its structural integrity. However, even if the fiber board 18 does not have properties that are similar to the material used to line the furnace walls, such that it will need to be replaced more often, this modular port block assembly 10 allows the fiber board 18 to be changed without changing the entire port block assembly 10.

In order to hold the extension piece 14 in the central passageway 20 of the refractory block 12, the refractory block 12 is provided with a first engagement structure in the central passageway 20 and the sidewall 40 of the extension piece 14 is provided with a second engagement structure. Engagement of the first engagement structure with the second engagement structure connects the extension piece 14 to the refractory block 12.

In the embodiment shown in FIGS. 1-3, the refractory block 12 has at least one lip 58 extending inward from the distal end 54 of the central passageway 20. The lip 58 only extends a portion of the distance around the circumference of the refractory block 12 and has a diameter $D_4$ that is less than the diameter $D_3$ of the second cylindrical section 32.

Optionally, as shown in another embodiment (FIGS. 5 and 6), the refractory block 12 may include a distal extension 74 having a diameter that is larger than the diameter $D_4$ of the at least one lip 58. The diameter of the distal extension 74 may be the same as the diameter $D_3$ of the second cylindrical section 32.

The first engagement structure comprises at least one recess 60 in the central passageway 20 of the refractory block 12 defined by the at least one lip 58 and ledge 30 and the second engagement structure comprises an outwardly extending bulge 44 in the sidewall 40 at the proximal end 38 of the extension piece 14. The refractory block 12 is connected to the extension piece 14 when the bulge 44 is disposed within the recess 60.

The recess 60 and the bulge 44 may take any suitable shape, including, but not limited to, square, rounded, and angular, as long as the shape of the recess 60 and the bulge 44 sufficiently correspond such that the bulge 44 can be received in the recess 60 such that the extension piece 14 is retained in the central passageway 20 of the refractory block 12 by the lip 58. In the embodiments shown in FIGS. 1-8, the recess 60 has a square shape and the bulge 44 has a rounded shape.

The engagement structures in this embodiment are configured as follows. The outer diameter $d_1$ of the extension piece 14 at the bulge 44 is smaller than the diameter $D_3$ of the central passageway 20 of the refractory block 12 at the recess 60 and larger than the diameter $D_4$ of the central passageway 20 of the refractory block 12 at the lip 58.

If an indentation 46 is provided adjacent the bulge 44 on the extension piece 14, the indentation 46 on the extension piece 14 and the lip 58 on the refractory block 12 may also cooperate to help connect the refractory block 12 to the extension piece 14. In this case, the outer diameter $d_2$ of the extension piece 14 at the indentation 46 is less than the diameter $D_4$ of the central passageway 20 of the refractory block 12 at the lip 58 such that the lip 58 is at least partially disposed in the indentation 46 when the bulge 44 is disposed in the recess 60.

The outer diameter $d_3$ of the longitudinal section 48 of the sidewall 40 of the extension piece 14 is greater than the diameter $D_4$ of the central passageway 20 of the refractory block 12 at the lip 58 and smaller than the diameter of the hole 56 in the fiber board 18.

To attach the extension piece 14 to the refractory block 12, the proximal end 38 of the extension piece 14 is aligned with the refractory block 12 such that the area free from the bulge 44 is aligned with the lip 58 of the refractory block 12. The extension piece 14 is then inserted in the central passageway 20 of the refractory block 12 until the proximal end 38 of the extension piece 14 abuts the ledge 30. The extension piece 14 is then rotated with respect to the refractory block 12 until the bulge 44 is disposed within the recess 60 and, if an indentation 46 is present, the lip 58 is disposed within the indentation 46. The longitudinal section 48 of the extension piece 14 is disposed within the hole 56 of the fiber board 18.

In the embodiments shown in FIGS. 1-8, the refractory block 12 has two lips 58 and the extension piece 14 has two bulges 44. The lips 58 are positioned opposite to one another on the circumference of the central passageway 20 of the refractory block 12, i.e., 180° apart, forming two opposing recesses 60 in the central passageway 20 of the refractory block 12. The bulges 44 are positioned opposite to one another on the circumference of the extension piece 14, i.e., 180° apart. Two indentations 46 are adjacent the bulges 44.

To attach the extension piece 14 to the refractory block 12, the proximal end 38 of the extension piece 14 is aligned with the refractory block 12 such that the areas free from the bulges 44 are aligned with the lips 58 of the refractory block 12, i.e., such that each bulge 44 is aligned with a space between the two lips 58. The extension piece 14 is then inserted in the central passageway 20 of the refractory block 12 until the proximal end 38 of the extension piece 14 abuts the ledge 30. The extension piece 14 is then rotated with respect to the refractory block 12 until the bulges 44 are disposed within the recesses 60 and the lips 58 are disposed within the indentations 46. The lip 58 not only locks the extension piece 14 to the refractory block 12, but also keeps the extension piece 14 from tilting with respect to the refractory block 12 by holding the bulge 44 within the recess 60.

The distance from the ledge 30 to the exterior of the surface of the fiber board 18 is preferably slightly shorter than the distance between the proximal end 38 of the extension piece 14 to the flange 50 extending from the distal end 36 of the extension piece 14. In this way, when the extension piece 14 is connected to the refractory block 12, the flange 50 on the distal end 36 of the extension piece 14 aids in securing the fiber board 18 to the refractory block 12 and creating a well connected assembly.

Fiber gasket 16 may be placed between the refractory block 12 and the extension piece 14. The fiber gasket 16 may be placed around the proximal end 38 of the extension piece 14 that will contact the refractory block 12 when the port block assembly 10 is assembled and held in place using a suitable method, including, but not limited to, tape and adhesive. The means for securing the fiber gasket 16 should allow the fiber gasket 16 to expand when the burner is in use or should burn away upon the first use of the burner to allow the fiber gasket 16 to expand. The fiber gasket 16 acts to seal the refractory block 12 and the extension piece 14 to contain the hot gases and reduces stress concentration loads which may form at the contact points between the refractory block 12 and the extension piece 14 due to dissimilarity of the thermal expansion coefficients of the extension piece 14 and the refractory block 12. The fiber gasket 16 may be made from any suitable material that performs these functions, including, but not limited to, fiberfrax paper.

The port block assembly 10 can be constructed by attaching at least one fiber board 18 to the distal end 54 of the refractory block 12 such that the longitudinal axis of the hole 56 in the fiber board 18 is aligned with the longitudinal axis A of the central passageway 20. A fiber gasket 16 is wrapped around and secured to the proximal end 38 of the extension piece 14 and the extension piece 14 is then inserted in the central passageway 20 of the refractory block 12. Then, the first engagement structure in the central passageway 20 of the refractory block 12 is engaged with the second engagement structure on the sidewall 40 of the extension piece 14 to connect the extension piece 14 to the port block assembly 10.

In the embodiments shown in FIGS. 1-8, the insertion of the extension piece 14 and the engagement of the engagement structures may be completed as previously described.

Figure 6:
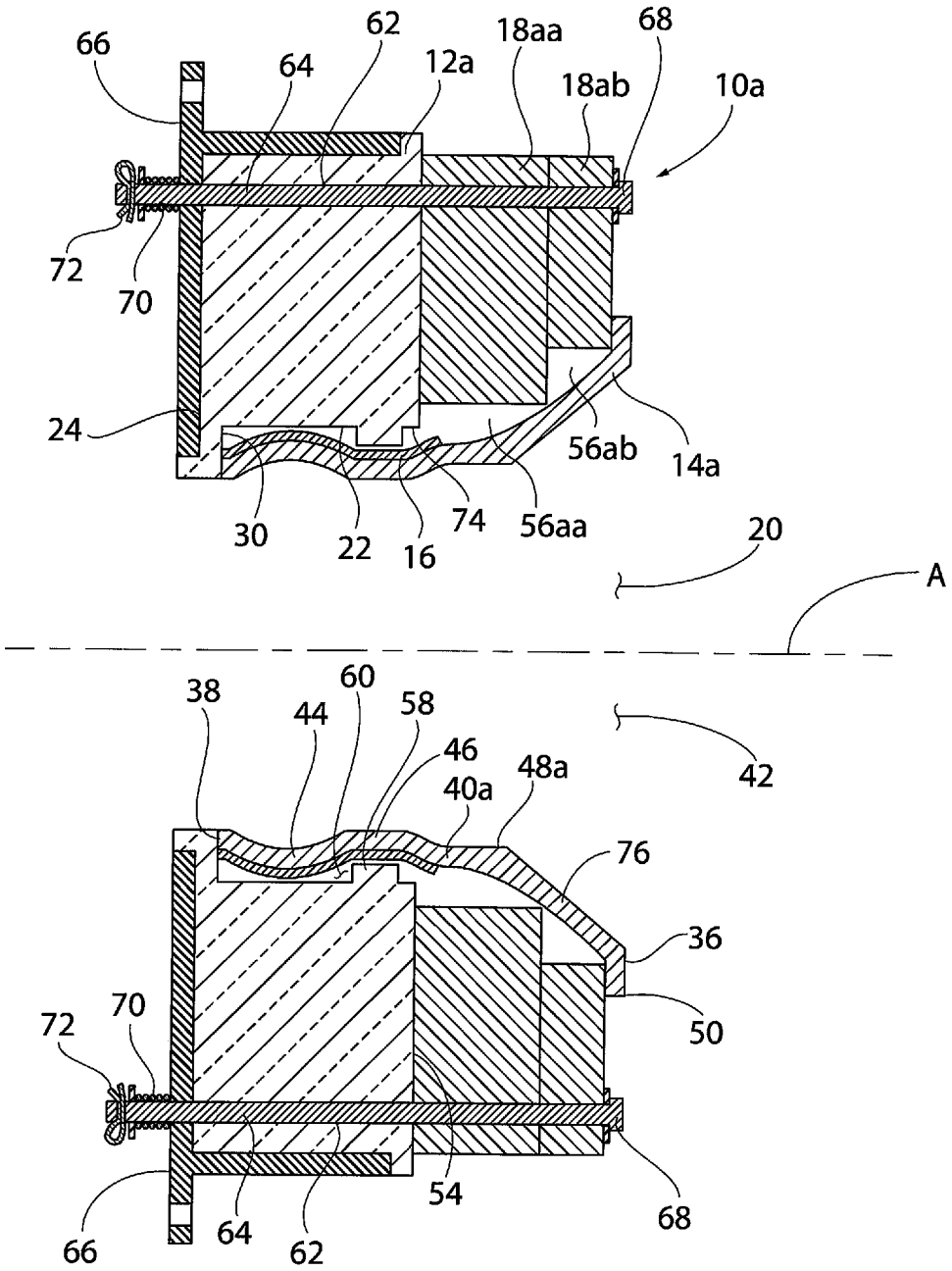
FIG. 6 is a cross-sectional view along a longitudinal axis of a port block assembly according to a second embodiment of the present invention.
Figure 7:
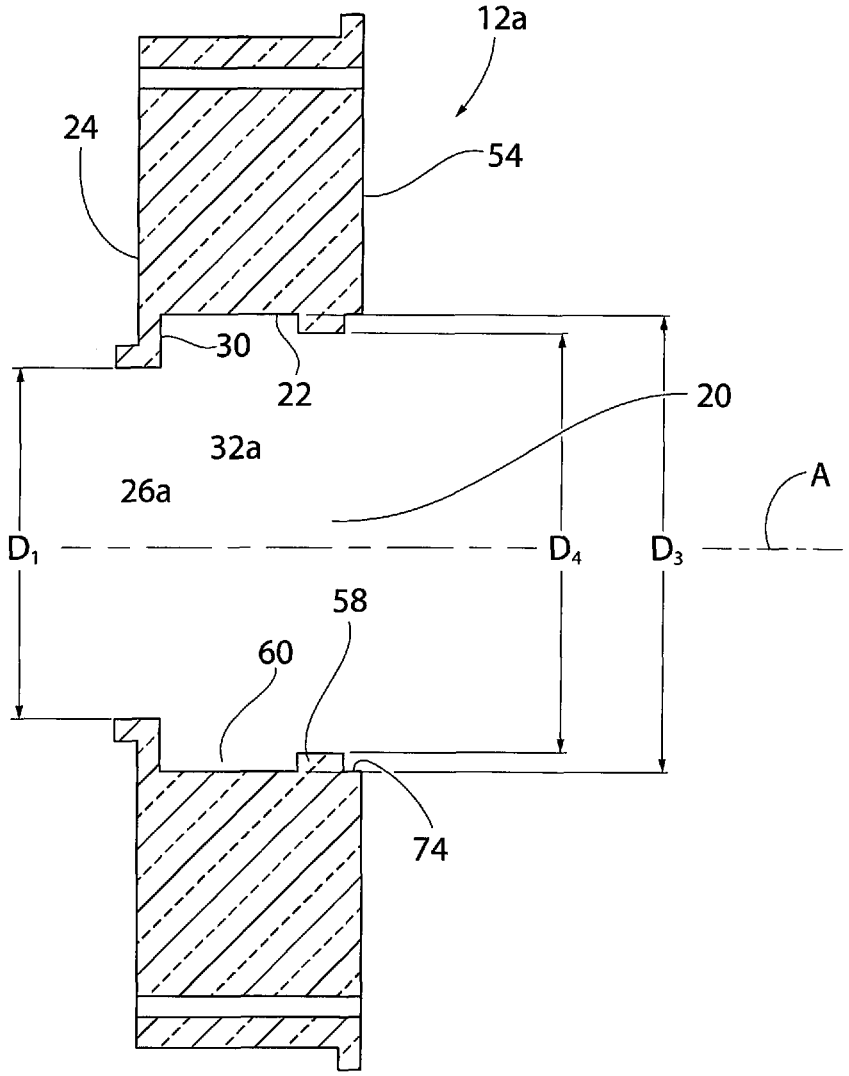
FIG. 7 is a cross-sectional view along a longitudinal axis of a refractory block of a port block assembly according to a second embodiment of the present invention.
Figure 8:
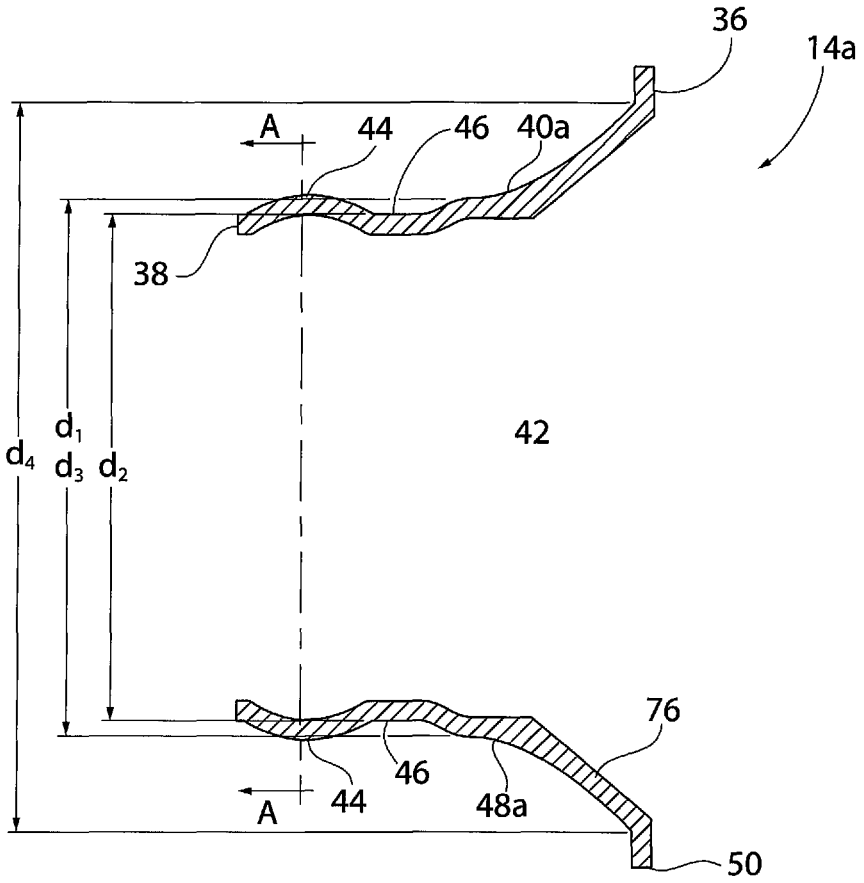
FIG. 8 is a cross-sectional view along a longitudinal axis of an extension piece of a port block assembly according to a second embodiment of the present invention.

A second embodiment 10*a*, shown in FIGS. 6-8, is similar to the first embodiment 10 except the refractory port block 12*a* only has a first cylindrical section 26*a* and a second cylindrical section 32*a*, and the extension piece 14*a* has a shorter longitudinal section 48*a* and includes a frustoconical section 76 that extends beyond the longitudinal section 48*a*. The sidewall 40*a* of the extension piece 14*a* in the frustoconical section 76 has an outer diameter equal to the diameter $d_3$ of the longitudinal section 48*a* at its proximal end and flares outward to a diameter $d_4$ at its distal end.

Two fiber boards 18*aa*, 18*ab* may be used with a hole 56*aa* in the first fiber board 18*aa*, being smaller than a hole 56*ab* in the second fiber board 18*ab* such that the passageway through the holes 56*aa*, 56*ab* in the fiber boards 18*aa*, 18*ab* approximates the shape of the outside surface of the longitudinal section 48*a* and the frustoconical section 76 of the extension piece 14*a*.

This port block assembly having a two piece construction provides many benefits over prior art monolithic port blocks including an easily replaceable low cost ceramic insert, lower weight compared to a block completely made from castable refractory, lower thermal conductivity compared to a block completely made from castable refractory providing lower external temperatures at the burner mounting location, high resistance to thermal shock, and a modular assembly where parts may be replaced independent of one another. In particular, this port block assembly having a two piece construction can be heated at much higher heat up rates than the prior art monolithic port blocks without any damage to the port block assembly. A port block assembly according to this invention installed in a cold furnace was heated to 2200° F. in less than one hour with no damage. On the other hand, prior art port blocks must be heated at a rate of no more than 100° F./hour to avoid damage.

The invention claimed is:

1. A burner port block assembly comprising:

a refractory block having a central passageway therethrough and at least one lip extending inward from a distal end of the central passageway; and a ceramic extension piece having a distal end, a proximal end, and a sidewall that defines a central passageway extending between the distal end and the proximal end, wherein the extension piece is disposed at least partially in the central passageway of the refractory block, wherein the refractory block comprises a first engagement structure and the extension piece comprises a second engagement structure and engagement of the first engagement structure with the second engagement structure connects the extension piece to the refractory block.

2. The burner port block assembly of claim 1, wherein the first engagement structure is in the central passageway of the refractory block.

3. The burner port block assembly of claim 1, wherein the second engagement structure is on the sidewall of the extension piece.

4. The burner port block assembly of claim 1, wherein the extension piece further comprises at least one outwardly extending bulge in the sidewall at the proximal end.

5. The burner port block assembly of claim 4, wherein the extension piece further comprises an indentation in the sidewall adjacent the at least one bulge and a longitudinal section of the sidewall adjacent the indentation.

6. The burner port block assembly of claim 5, further comprising at least one ceramic fiber board having a hole therethrough, wherein the fiber board is located at a distal end of the refractory block and a longitudinal axis of the hole is aligned with a longitudinal axis of the refractory block and an outer diameter of the longitudinal section of the sidewall of the extension piece is less than a diameter of the hole.

7. The burner port block assembly of claim 1, wherein the extension piece further comprises an outwardly extending flange at the distal end.

8. The burner port block assembly of claim 7, further comprising at least one ceramic fiber board having a hole therethrough, wherein the fiber board is located at a distal end of the refractory block and a longitudinal axis of the hole is aligned with a longitudinal axis of the refractory block and the outwardly extending flange abuts an outer surface of the at least one ceramic fiber board.

9. The burner port block assembly of claim 1, wherein the extension piece further comprises an indentation in the sidewall and an outer diameter of the extension piece at the indentation is less than a diameter of the central passageway of the refractory block at the at least one lip.

10. The burner port block assembly of claim 9, wherein the extension piece further comprises a longitudinal section adjacent the indentation and an outer diameter of the longitudinal section of the sidewall of the extension piece is greater than the diameter of the central passageway of the refractory block at the at least one lip.

11. The burner port block assembly of claim 1, wherein the first engagement structure comprises at least one recess in the central passageway of the refractory block defined by the at least one lip and the second engagement structure comprises at least one outwardly extending bulge at the proximal end of the sidewall of the extension piece, wherein the refractory block is connected to the extension piece when the bulge is disposed within the recess.

12. The burner port block assembly of claim 11, wherein an outer diameter of the extension piece at the at least one bulge is smaller than a diameter of the central passageway of the refractory block at the recess and larger than a diameter of the central passageway of the refractory block at the at least one lip.

13. The burner port block assembly of claim 11, wherein the extension piece further comprises an indentation in the sidewall adjacent the at least one bulge.

14. The burner port block assembly of claim 13, wherein an outer diameter of the extension piece at the indentation is less than the diameter of the central passageway of the refractory block at the at least one lip such that the lip is at least partially disposed in the indentation when the bulge is disposed in the recess.

15. The burner port block assembly of claim 1, wherein the first engagement structure comprises two recesses in the central passageway of the refractory block defined by two lips and the second engagement structure comprises two outwardly extending bulges at a proximal end of the sidewall of the extension piece, wherein the recesses are opposite one another on a circumference of the central passageway of the refractory block and the bulges are opposite one another on a circumference of the extension piece.

16. The burner port block assembly of claim 1, further comprising a gasket positioned between the refractory block and the extension piece.

17. The burner port block assembly of claim 16, wherein the gasket is ceramic fiber.

18. The burner port block assembly of claim 16, wherein the gasket covers the outer circumference of the proximal end of the extension piece.

19. The burner port block assembly of claim 1, further comprising at least one ceramic fiber board having a hole therethrough, wherein the fiber board is located at a distal end of the refractory block and a longitudinal axis of the hole is aligned with a longitudinal axis of the refractory block.

20. The burner port block assembly of claim 1, wherein the extension piece is comprised of silicon carbide.

21. A method of constructing a burner port block assembly comprising:

providing a refractory block having a central passageway therethrough, a first engagement structure in the central passageway, and at least one lip extending inward from a distal end;

attaching at least one ceramic fiber board having a hole therethrough to the distal end of the refractory block such that a longitudinal axis of the hole is aligned with a longitudinal axis of the refractory block;

providing an extension piece having a distal end, a proximal end, a sidewall defining a central passageway extending between the distal end and the proximal end, and a second engagement structure on the sidewall;

placing a gasket around the proximal end of the extension piece;

inserting the extension piece into the central passageway of the refractory block; and rotating the extension piece with respect to the refractory block to engage the first engagement structure with the second engagement structure.

* * * * *